US006601747B1

(12) United States Patent
Chi Kuo

(10) Patent No.: US 6,601,747 B1
(45) Date of Patent: Aug. 5, 2003

(54) OFFICE TOOL ASSEMBLY

(76) Inventor: Su-Chao Chi Kuo, No. 68, Kuang-Cheng Rd., Tali City, Taichung Hsien (TW)

( * ) Notice: Subject to any disclaimer, the term of this patent is extended or adjusted under 35 U.S.C. 154(b) by 0 days.

(21) Appl. No.: 10/366,153

(22) Filed: Feb. 13, 2003

(51) Int. Cl.[7] ..... B25C 5/02
(52) U.S. Cl. ..... 227/76; 227/134; 227/156
(58) Field of Search ..... 227/76, 134, 156; 173/170

(56) References Cited

U.S. PATENT DOCUMENTS 4,014,493 A * 3/1977 Wolfe ..... 227/156
4,278,017 A * 7/1981 Conjura ..... 227/156
4,727,610 A * 3/1988 Lin ..... 227/156
5,690,268 A * 11/1997 Evans et al. ..... 227/156
5,797,535 A * 8/1998 Lovegrove et al. ..... 227/134
6,152,347 A * 11/2000 Wilson et al. ..... 227/134
6,338,430 B1 * 1/2002 Cheng ..... 227/134

* cited by examiner

*Primary Examiner*—Scott A. Smith
(74) *Attorney, Agent, or Firm*—Alan D. Kamrath; Rider Bennett, LLP.

(57) ABSTRACT

An office tool assembly has a tool and a hanging cap. The tool is inserted into and is held in the hanging cap. A protrusion is formed on the tool to engage with a through hole defined in the cap to keep the tool from falling out of the hanging cap. A transverse hole is defined in the hanging cap through which a string passes, such that the tool assembly can be hung around a person's neck. Accordingly, a user can conveniently and safely carry the tool assembly to any desired place for use.

3 Claims, 4 Drawing Sheets

OFFICE TOOL ASSEMBLY

BACKGROUND OF THE INVENTION

1. Field of the Invention

The present invention relates to an office tool assembly, and more particularly to an office tool assembly that can be hung around a person's neck or a belt.

2. Description of Related Art

Office tools, such as hole punches staplers, are used to to attach documents. A stapler holds multiple documents together with staples, and a hole punch make holes in documents so a string or clip can extending through the holes to hold the documents together. However, conventional office tools are not convenient for a person to carry or to use outside of the office, especially a salesman or a serviceman at an off-site location. Furthermore, staples in a stapler can easily injure a person. To use and carry a conventional office tool is inconvenient and unsafe.

To overcome the shortcomings, the present invention provides an office tool assembly to mitigate or obviate the aforementioned problems.

SUMMARY OF THE INVENTION

The main objective of the invention is to provide an office tool assembly that can be hung around a person's neck to conveniently and safely carrying the tool assembly. The office tool assembly in accordance with the present invention has a hanging cap and a tool. The tool is held in the hanging cap. A protrusion is formed on the tool to engage a through hole defined in the hanging cap to keep the tool from falling out of the hanging cap. A transverse hole is defined through the hanging cap, and a string, cord, chain or the like passes through the transverse hole so the tool assembly can hang around a person's neck. Carrying the office tool assembly is convenient and safe.

Other objectives, advantages and novel features of the invention will become more apparent from the following detailed description when taken in conjunction with the accompanying drawings.

DETAILED DESCRIPTION OF PREFERRED EMBODIMENT

Figure 1:
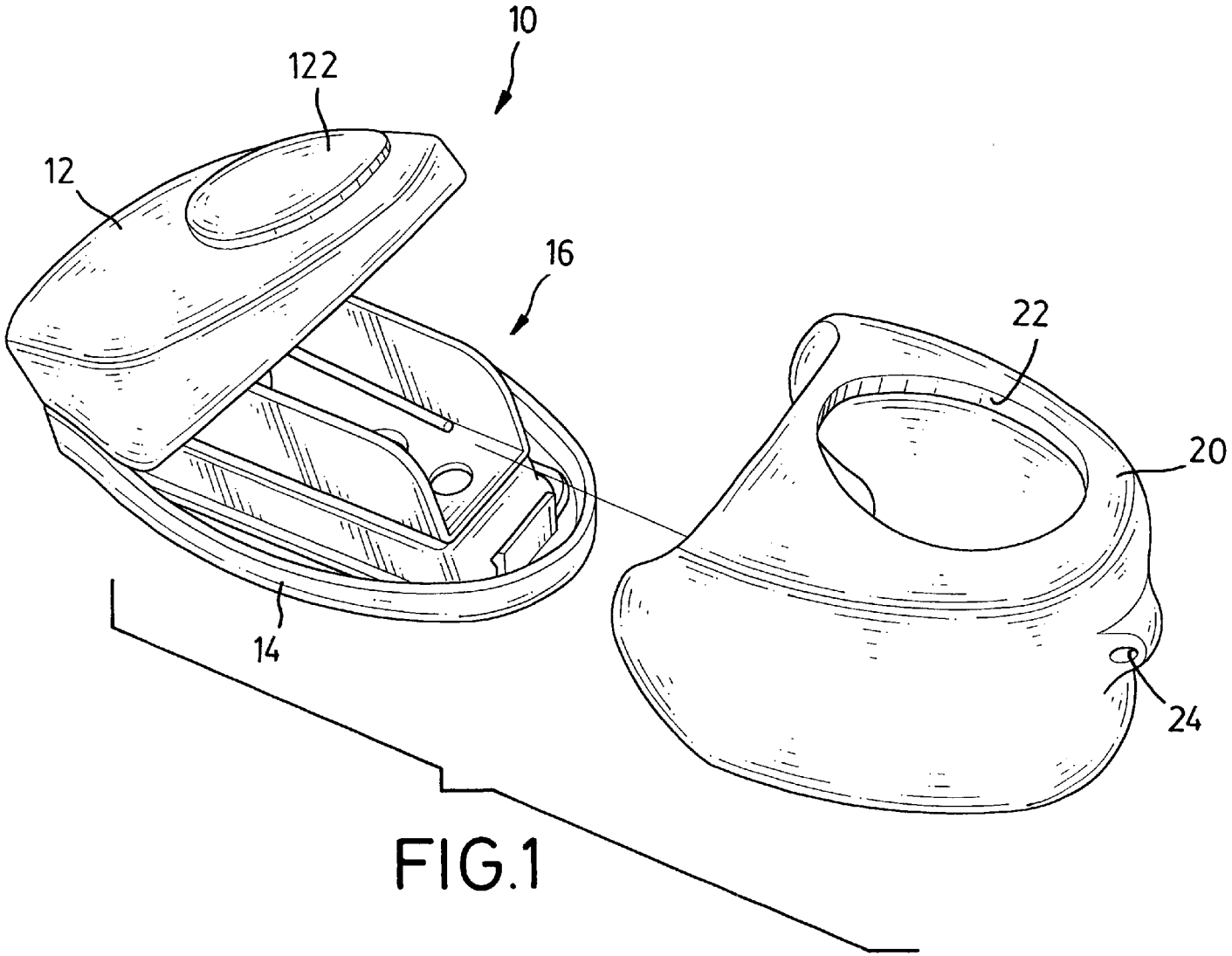
FIG. 1 is an exploded perspective view of a first embodiment of an office tool assembly in accordance with the present invention.
Figure 2:
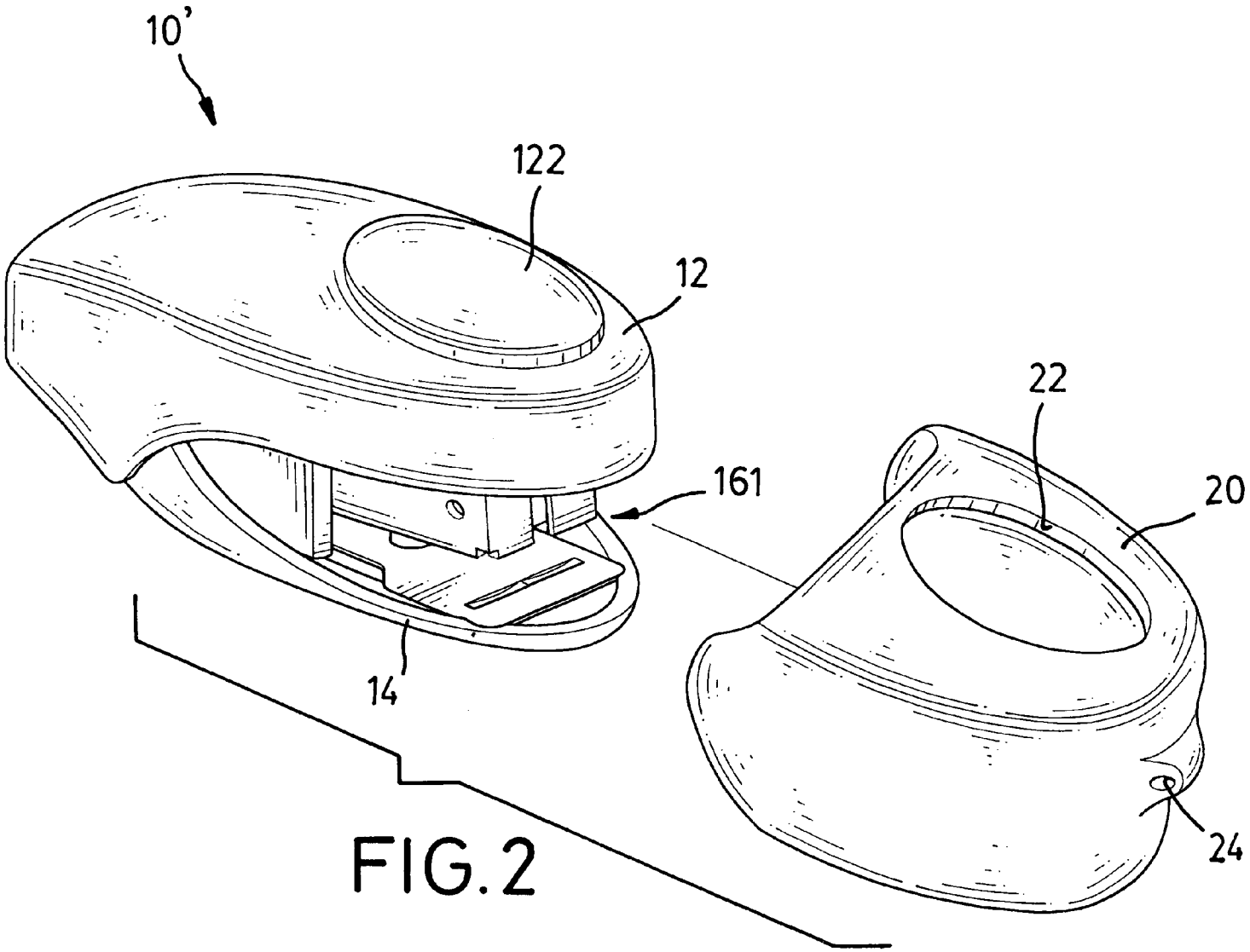
FIG. 2 is an exploded perspective view of a second embodiment of an office tool assembly in accordance with the present invention.

With reference to FIGS. 1 and 2, an office tool assembly in accordance with the present invention comprises a tool (10, 10') and a hanging cap (20). The tool (10, 10') is held in the hanging cap (20). The tool (10, 10') has an upper cover (12) with a top, a bottom cover (14) and a main mechanism (16, 16'). The main mechanism (16, 16') is mounted between the upper cover (12) and the bottom cover (14), and the bottom cover (14) is pivotally connected to the upper cover (12) through the main mechanism (16, 16'). In practice, the main mechanism (16) is a hole-punching mechanism to make the office tool (10) a hole punch. In another embodiment, the main mechanism (16') is a stapler mechanism to make the office tool (10') a stapler. A protrusion (122) is formed on the top of the upper cover (12).

The hanging cap (20) has a top, an open end (not numbered) into which the tool (10, 10') is inserted and a closed end opposite to the open end. A through hole (22) is defined in the top of the hanging cap (20) to engage the protrusion (122) on the upper cover (12) of the tool (10, 10'). When the protrusion (122) is in the through hole (22), the tool (10, 10') will not fall out of the hanging cap (20). A transverse hole (24) is defined through the closed end of the hanging cap (20).

Figure 3:
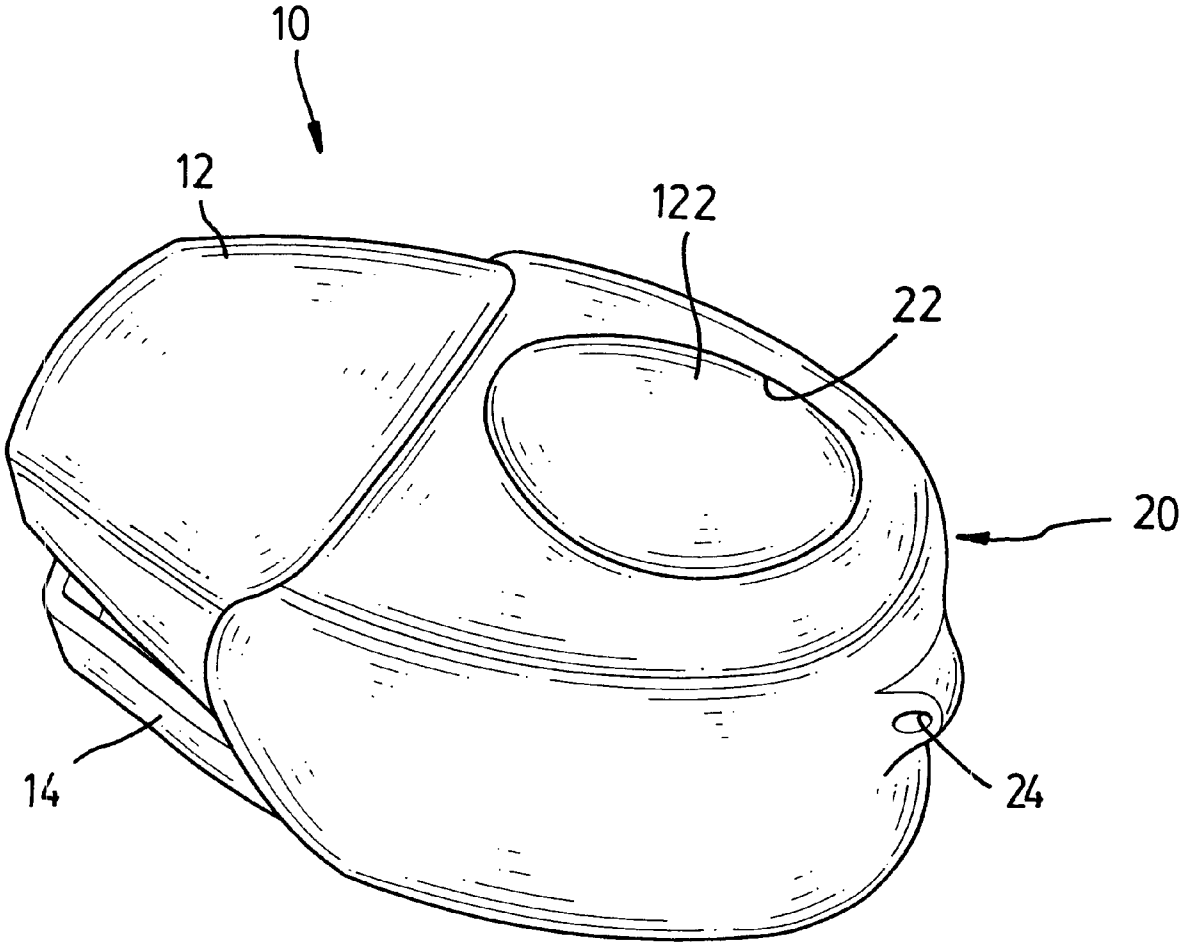
FIG. 3 is a perspective view of the office tool assembly in FIGS. 1 and 2.
Figure 4:
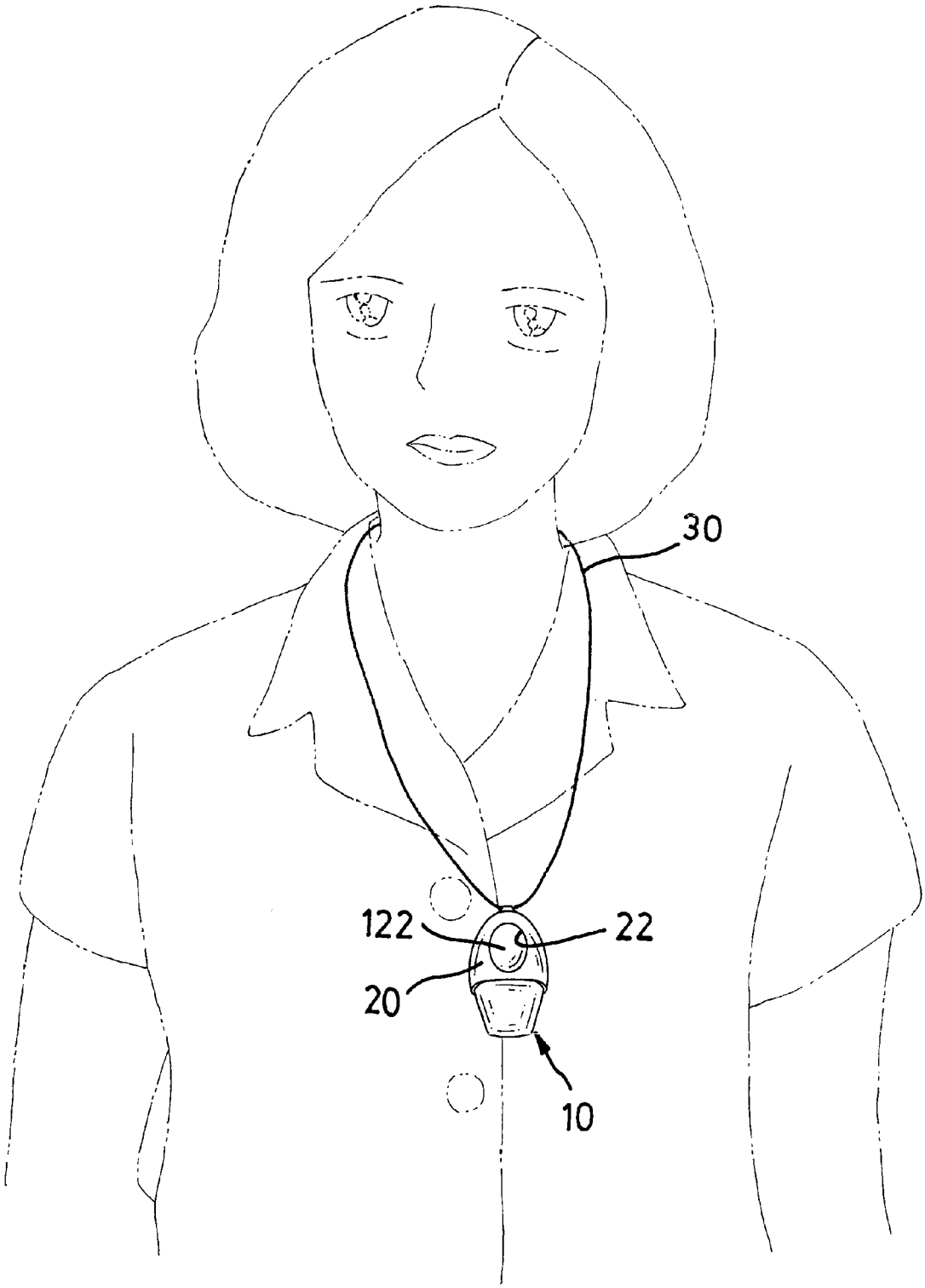
FIG. 4 is an operational top plan view of the office tool assembly in FIG. 3 hung around a person's neck with a string.

With reference to FIGS. 3 and 4, a string (30) penetrates through the transverse hole (24) in the hanging cap (20) so a person can hang the hanging cap (20) with the tool (10) around the neck with the string (30). Accordingly, a person can conveniently and easily carry the tool (10) to any desired place and can keep his or her hands free. When the person wants to use the tool (10), the person pushes the protrusion (122) downward through the through hole (22) in the hanging cap (20) to release the protrusion (122) from the through hole (22). Consequently, the tool (10) can be removed from the open end of the hanging cap (20), and the tool (10) can be used on document. When the tool (10) is no longer being used, the tool (10) is inserted into and held in the hanging cap (20). With the tool (10) in the hanging cap (20), the user will not be injured by the tool (10) even when staples are in the tool (10). The safety of using and carrying the office tool assembly is improved. In another operational embodiment, the tool assembly in accordance with this present invention can be connected to a key chain or can be hung on a belt, a bag or an object through a string, such that the use of the office tool assembly is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An office tool assembly comprising:

a hanging cap with a top, an open end and a closed end and having a through hole defined in the top of the hanging cap and a transverse hole defined through the closed end; and a tool inserted into the open end of the hanging cap and held in the hanging cap, the tool comprising:

an upper cover with a top and having a protrusion formed on the top of the upper cover and engaging the through hole in the hanging cap;

a bottom cover pivotally connected to the upper cover; and a main mechanism mounted between the upper cover and the bottom cover.

2. The office tool as claimed in claim 1, wherein the main mechanism is a stapler mechanism to make the office tool a stapler.

3. The office tool as claimed in claim 1, wherein the main mechanism is a hole-punching mechanism to make the office tool a hole punch.

* * * * *